US005875529A

United States Patent [19]

Ollier

[11] Patent Number: 5,875,529

[45] Date of Patent: Mar. 2, 1999

[54] SHEET METAL CASKET

[75] Inventor: Kean Ollier, Batesville, Ind.

[73] Assignee: Batesville Casket Company, Inc., Batesville, Ind.

[21] Appl. No.: 861,642

[22] Filed: May 22, 1997

[51] Int. Cl.[6] ..... A61G 17/00

[52] U.S. Cl. ..... 27/6; 27/10; 27/2; 27/DIG. 1

[58] Field of Search ..... 27/1, 2, 6, 10, 27/14, 16, DIG. 1

[56] References Cited

U.S. PATENT DOCUMENTS

| | | | |
|---|---|---|---|
| 2,323,674 | 7/1943 | Purkiss . | |
| 2,417,756 | 3/1947 | Hillenbrand . | |
| 2,582,841 | 1/1952 | McEwan . | |
| 2,587,355 | 2/1952 | McEwan . | |
| 4,697,316 | 10/1987 | Semon | 27/2 X |
| 5,457,861 | 10/1995 | Lloyd . | |

OTHER PUBLICATIONS

Steel Caskets brochure ©1991, 8 pages Batesville Casket Company, Inc., Batesville, IN.

One engineering drawing of end tube crimped in place on casket with square corners, Aug. 20, 1991.

*Primary Examiner*—Brian K. Green
*Assistant Examiner*—William L. Miller
*Attorney, Agent, or Firm*—Wood, Herron & Evans, L.L.P.

[57] ABSTRACT

A sheet metal casket comprises a pair of side panels, a pair of end panels, a rounded corner between adjacent ends of the adjacent side and end panels, at least one rounded corner having a flat formed thereon, the flat having a hole formed therethrough, and a tube positioned in the hole and crimped in place.

31 Claims, 3 Drawing Sheets

SHEET METAL CASKET

FIELD OF THE INVENTION

This invention relates generally to caskets, and more particularly to sheet metal caskets of the type which may include a wedge bar type locking mechanism and/or a record tube.

BACKGROUND OF THE INVENTION

Sheet metal has heretofore been employed as a material from which to fabricate caskets. A casket includes a shell to which is pivoted one or two caps or lids. The casket shell includes a pair of side walls or panels, a pair of end walls or panels and a bottom wall or panel. The panels are of course stamped from sheet metal. The stampings from which the shell is constructed may include decorative curves or the like or they may be simply planar in shape. The panels are interconnected along adjacent edges. The particular metal from which the casket is fabricated generally determines the means of mechanically joining the panels, e.g. brazing, soldering or welding.

Sheet metal caskets include a shell having a ledge around the periphery of an upper edge of the shell. A locking mechanism spans the length of the ledge therein. One type of locking mechanism employed is known as a wedge bar type locking mechanism, an example of which is disclosed in U.S. Pat. No. 5,503,439 assigned to the assignee of the present invention and hereby incorporated by reference herein as if fully set forth in its entirety. In this type of locking mechanism, an elongated bar includes a series of catches which, when the bar is translated in a first direction, engage with pulldown fasteners secured to the lid to lock the lid to the shell, and when the bar is translated in a second direction, disengage from the pulldown fasteners to allow the lid to be opened. An Allen head screw is utilized to actuate the bar. The screw may reside in a tube secured to an end panel of the shell.

A sheet metal casket may also include a record tube, i.e. a rather short, small diameter tube into which is inserted a small rolled-up piece of paper including information, for example, identification of the deceased. Such a tube may also be secured to an end panel of the shell.

Since the above described tubes may not be formed as part of the end panel during stamping of the panel, the tube must be somehow mechanically attached to the panel. The tube may be brazed, soldered or welded to the end panel, or the tube may be crimped to the end panel.

Crimping the tube to the end panel is much more desirable than brazing, soldering or welding the tube to the end panel, since all of these steps generate environmentally undesirable fumes and are labor intensive requiring a separate non-automatable hand operation. Further, some metals from which sheet metal caskets are fabricated do not lend themselves well to brazing, soldering or welding. Still further, the brazed/soldered/welded joint ("heat fused joint") must be dressed down by hand to present an aesthetically pleasing joint between the tube and the panel, thus making the operation even more labor intensive. Lastly, since the brazing, soldering and welding, and subsequent dressing down operations, are performed by hand, repeatability is difficult to control.

Crimping the tube to the end panel is much more desirable than heat fusing the tube to the end panel since crimping does not include the attendant disadvantages discussed above and because the crimping step is readily automated.

When the casket shell is constructed from flat or planar end panels, i.e. end panels without curved or rounded side edges, the tube, whether for the locking mechanism or for the record tube, is and has heretofore been readily crimped to the flat panel and is therefore well known in the art. This known crimping step is performed by inserting an end of the tube through a hole formed in the flat end panel, sliding an O-ring onto the inserted end of the tube and against the surface of the end panel and crimping the tube around the O-ring and towards the end panel surface. Since the tube includes a surface which is perpendicular to the longitudinal axis of the tube for abutting against the end panel, the installed tube is perpendicular to the plane of the end panel once installed and thus parallel to the longitudinal axis of the casket.

However, in casket designs which include curved or rounded corners in the regions where the shell side panels and end panels transition towards one another, crimping has heretofore not been employable as a means of attaching the tube. This is because the area where the tube is installed, i.e. at either corner near an upper end thereof, is rounded which effectively prevents the tube from being crimped in place, since it is preferable to install the tube parallel to the longitudinal axis of the casket. If the tube were crimped in place on such a corner, the installed tube would be perpendicular to the tangent plane of the corner, and thus would not be parallel to the longitudinal axis of the casket. Therefore, in casket designs utilizing rounded corners the tubes have heretofore been required to be heat fused in place, with all the attendant disadvantages discussed above.

It would therefore be desirable to be able to crimp a tube to a rounded casket corner or to a casket shell panel including a rounded corner, rather than having to heat fuse the tube in place.

Accordingly, the present invention provides a method of making a sheet metal casket including attaching a tube to a rounded corner of the casket shell by crimping, and a casket made according to that method.

SUMMARY OF THE INVENTION

In accordance with the present invention, a method is provided of making a casket which includes a sheet metal shell having a pair of side panels and a pair of end panels cooperating with the side panels to define rounded corners, the casket further including a receptacle installed at one of the rounded corners. The method comprises the steps of providing a sheet metal casket shell rounded corner, forming a flat on the rounded corner, forming a hole through the flat, positioning a receptacle in the hole and crimping the receptacle in place in the hole.

The receptacle may be configured to receive either a memorial record tube or a wedge bar locking mechanism. The corner may further be a part of a panel, for example, a side panel or an end panel. In a a preformed embodiment the flat is formed parallel to a plane defined by the panel.

The receptacle includes an end inserted through the hole, and the method further comprises the steps of: surrounding the inserted end of the receptacle with an O-ring, abutting a surface of the panel with the O-ring, and crimping the inserted end of the receptacle around the O-ring and towards the panel surface.

Another method of the invention comprises the steps of providing a sheet metal casket shell end panel which has a rounded corner at each side edge thereof, forming a flat on at least one of the rounded corners, forming a hole through the flat, positioning a receptacle in the hole and crimping the receptacle in place in the hole.

In another aspect the present invention is a sheet metal casket. The casket comprises a pair of side panels and a pair of end panels which cooperate to define rounded corners of the shell. At least one rounded corner has a flat formed thereon, and the flat has a hole formed therethrough. A receptacle is positioned in the hole and is crimped in place.

The receptacle may be configured to receive a memorial record receptacle or a wedge bar locking mechanism. The flat is formed perpendicular to a longitudinal axis of the casket. A flat may be formed on both rounded corners at one end of the casket and a hole formed through each flat. In that case a receptacle configured to receive a memorial record tube may be positioned and crimped in one hole and a receptacle configured to receive a wedge bar locking mechanism may be positioned and crimped in the other hole, with each flat preferably being formed perpendicular to the longitudinal axis of the casket.

The receptacle includes an end inserted through the hole, and an O-ring surrounding the inserted end of the receptacle and abutting a surface of the panel. The inserted end is crimped around the O-ring and towards the panel surface.

Another casket of the invention comprises a pair of side panels and a pair of end panels attached to the pair of side panels. The end panels each have a rounded corner at each side edge thereof. At least one of the rounded corners of at least one of the end panels has a flat formed thereon, and has a hole formed through the flat. A receptacle is positioned in the hole and crimped in place.

According to another aspect of the invention, a method of making a casket shell comprises the steps of providing a sheet metal panel having a rounded portion, forming a flat in the rounded portion, forming a hole through the flat, positioning hardware in the hole, crimping the hardware in place in the hole, and utilizing the panel as a portion of the casket shell. The hardware could be a receptacle such as a tube for receiving a memorial record tube or wedge bar locking mechanism, or other hardware such as decorative hardware or lifting hardware. In a preferred embodiment, the panel additionally has a planar portion. The flat is formed on the rounded portion to be parallel to a plane defined by the planar portion.

In yet another aspect, a method of making a casket shell comprises the steps of providing a sheet metal panel having first and second portions. Each portion has a tangent plane associated therewith. The tangent planes are all oblique. A flat is formed on the first portion to be parallel to the tangent plane of the second portion. A hole is formed through the flat. Hardware is positioned in the hole, the hardware is crimped in place in the hole, and the panel is utilized as a portion of the casket shell. In one embodiment, the first portion of the panel is nonplanar and the second portion is planar. In another embodiment, both the first and second portions are planar.

The present invention thus provides a method of making a sheet metal casket which includes crimping a receptacle, for example a tube, to a rounded corner of a casket shell thus avoiding the need to attach the tube by heat fusing. The present invention also provides a casket made by this method.

These and other advantages of the present invention will become more readily apparent during the following detailed description taken in conjunction with the drawings herein, in which:

DETAILED DESCRIPTION OF THE INVENTION

Figure 1:
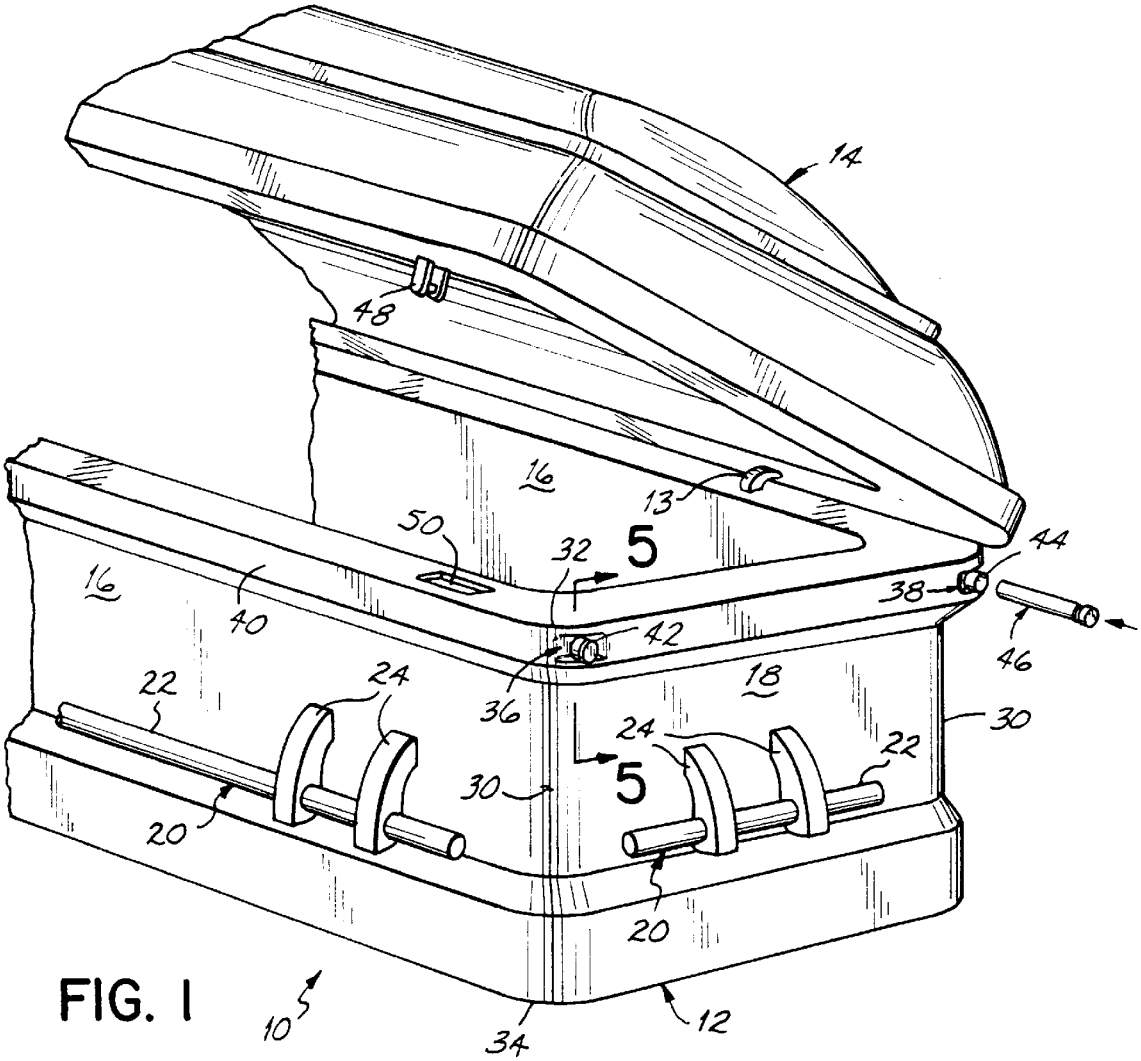
FIG. 1 is a partial perspective view of an end of a casket constructed according to the principles of the present invention illustrating a casket shell having side panels and end panels cooperating to define rounded corners and with a flat formed on each corner of one end of the casket shell.

Referring first to FIG. 1, there is illustrated a sheet metal casket 10 according to the principles of the present invention. The casket 10 includes a casket shell 12 to which is hinged or pivoted a cap or lid 14 as at 13. The shell 12 includes a pair of side panels 16, 16 and a pair of end panels, one of which is shown at 18, it being understood that there is another like end panel at the other end of the casket 10. Handling structure 20 takes the form of handle bars 22 mounted by arms 24 to the casket shell side and end panels 16, 18.

As illustrated in FIG. 1, casket shell 12 is formed to include rounded corners 30, the rounded portion of which extends from a top edge 32 of the shell 12 down to a bottom edge 34 of the shell 12. Shell 12 includes a flange 40. In areas 36, 38 of the flange 40 there are installed end tubes 42, 44 for a wedge bar locking mechanism (as is known in the art, not shown in the drawings) and a memorial record tube 46, respectively, as will be described in more detail below. The wedge bar locking mechanism locks the lid 14 down on the flange 40 of the shell 12 via hooks (not shown) which are part of the wedge bar mechanism. Those hooks engage pull-downs 48 on lid 14 through apertures 50 in the flange 40, as is known in the art. Memorial record tube 46 receives and contains information such as identification indicia of the deceased, as is also known in the art.

Figure 3:
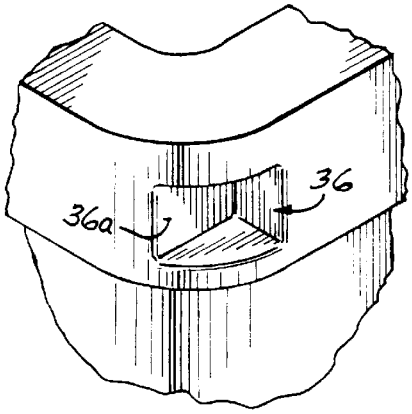
FIG. 3 is a partial perspective view of a rounded corner of an end panel including a flat formed thereon.
Figure 2:
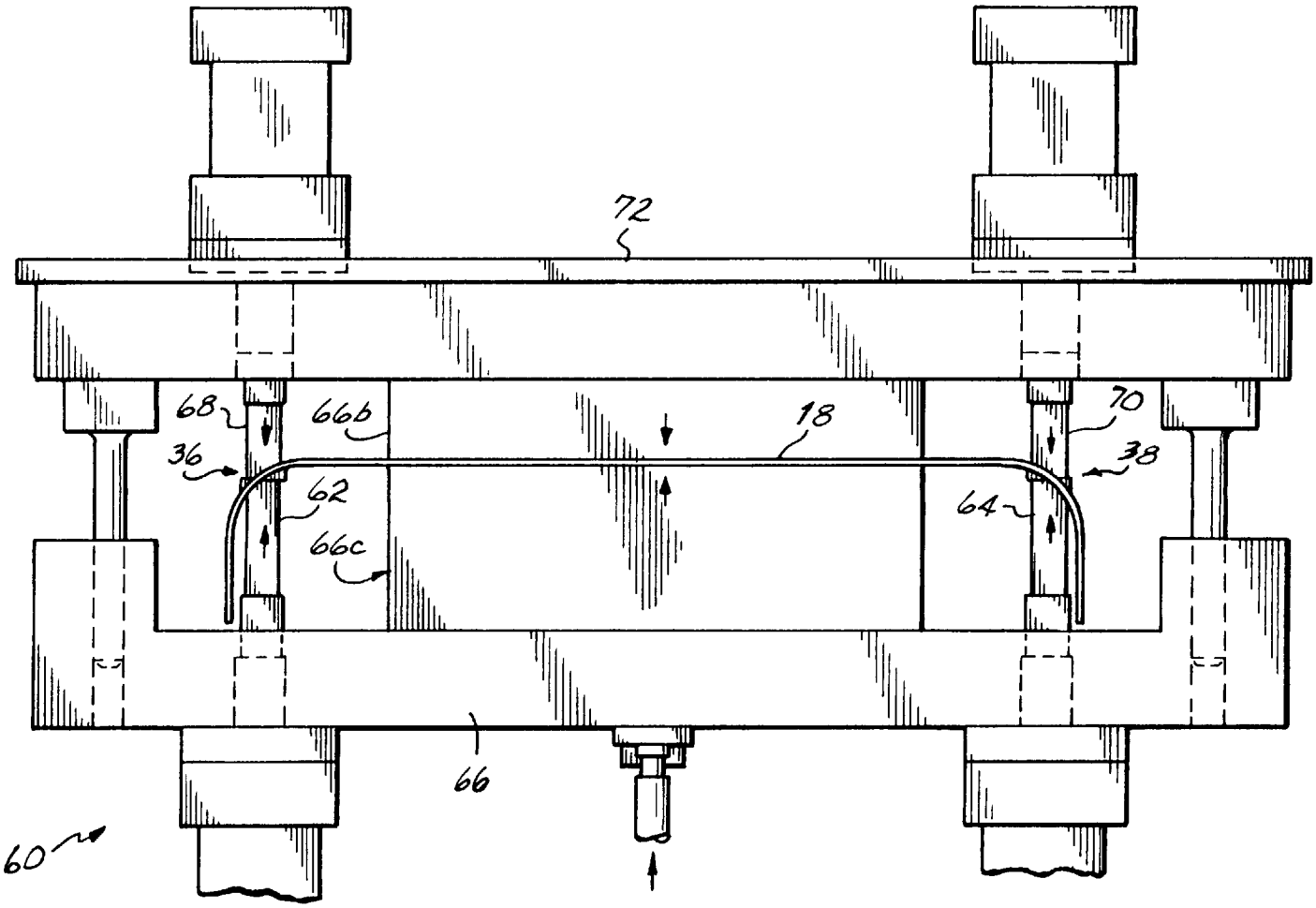
FIG. 2 is a top plan view of a press being used to form flats on the rounded corners of an end panel of the casket shell, the press including opposing dies for forming the flats.

Referring now to FIG. 2, there is illustrated a step in the fabrication of the casket 10 of the present invention. End panel 18 is fixtured in a press 60 having halves or portions 66, 72. The planar portion of the end panel 18 between the portions 36, 38 of the rounded corners 30 is supported by blocks 66*b*, 66*c* associated with press halves 72, 66 respectively. Dies 62, 64 associated with press portion 66 are simultaneously actuated with opposing dies 68, 70 associated with press portion 72 and are urged against areas 36, 38 respectively of the end panel 18 to thereby form flats at these areas 36, 38, with flat 36*a* being shown in FIG. 3. The flats 36*a*, 36*b* are generally parallel to a plane defined by the planar portion of the panel 18. Therefore, when panel 18 is later heat fused to side panels 16, flats 36*a*, 36*b* are generally perpendicular the longitudinal axis of the casket shell 12, i.e. the axis of symmetry of the casket in its lengthwise dimension.

Figure 4:
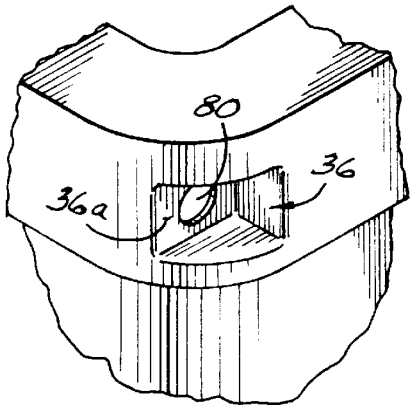
FIG. 4 is a view, similar to FIG. 3, of the flat with a hole formed therein.

A hole 80 is formed as by, for example, stamping or punching in each of the flats 36*a*, 36*b*. Hole 80 is shown in flat 36*a* in FIG. 4. These holes are formed via apparatus and method similar to that illustrated in FIG. 2. Once these holes are formed, receptacles such as mounting tubes are installed in the holes 80. Such receptacles may be configured to receive either a memorial record tube or a wedge bar locking mechanism.

Figure 5:
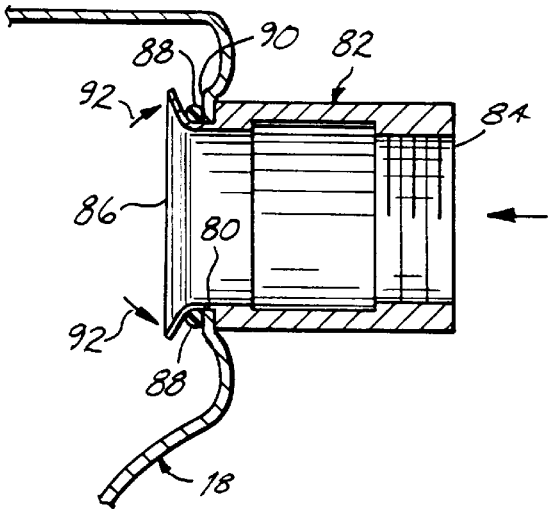
FIG. 5 is a view taken along line 5—5 of FIG. 1 illustrating one corner of the casket shell end panel formed with a flat, a hole formed through the flat and a tube installed and crimped in place.
Figure 6:
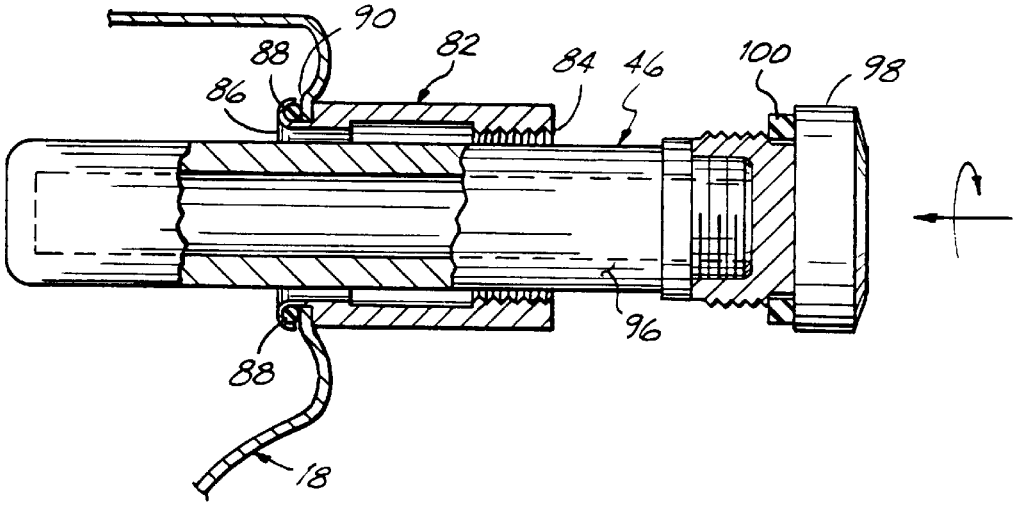
FIG. 6 is a view similar to FIG. 3 with a memorial record tube installed in the receptacle or mounting tube.

As is illustrated in FIG. 5 a mounting tube 82 preferably of steel having an internally threaded end 84 and a thin-walled other, inserted end 86 (for example on the order of about 0.027 inch (0.69 mm) thick to facilitate crimping which will be subsequently described) is inserted through hole 80 by first inserting end 86. A rubber (BUNA-N) O-ring 88 of durometer 90 ±10 is slipped over end 86 and abuts the inner wall 90 of the end panel 18. The end 86 is then crimped over the O-ring 88 and towards the inner wall 90 as is illustrated by arrows 92.

The memorial record tube 46 includes an externally threaded housing 96. Threaded onto this housing 96 is an internally and externally threaded brass cap 98. Cap 98 may be threaded into end 84 of tube 82 to complete the assembly. A gasket 100 of 60 durometer black PVC is disposed between the cap 98 and housing 96. Of course a similar mounting tube 82 can be crimped into the hole 80 in the other flat for installation therein of the wedge bar locking assembly (not shown).

End panel 18 is heat fused to the side panels 16 as is conventional in the art depending on the material selected for the casket, and a bottom panel (not shown) is similarly connected to the side and end panels 16, 18, as is conventional in the art. The wedge bar locking mechanism (not shown) and memorial record tube 46 are then installed and the casket is trimmed as is conventional to complete the manufacture and assembly of the casket.

It is to be understood that the term "tube" as used herein embraces any cross section, whether it be circular, square, rectangular or the like. And, other receptacles other than "tubes" can be used in the practice of the present invention. Furthermore, hardware other than receptacles, such as decorative hardware, lifting hardware and the like can be employed in the practice of the present invention.

Figure 7:
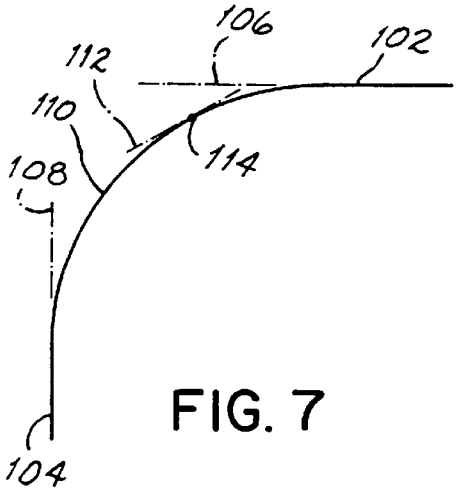
FIG. 7 is a top plan view of a casket corner illustrating the tangent planes of the planar portions of the casket shell end panel and side panel and the tangent plane of the rounded portion.

Referring now to FIG. 7, there is illustrated a rounded corner of a casket shell. The rounded corner includes planar portions 102 and 103. Portion 102 will be, for example, the planar portion of an end panel, and portion 103 will be, for example, the planar portion of a side panel. Planar portion 102 includes a tangent plane 106 associated therewith. Similarly, planar portion 104 includes a tangent plane 108 associated therewith. At any point between planar portions 102 and 104, for example, at point 114, a tangent plane 112 is associated therewith. Thus, it will be appreciated that tangent plane 112 is oblique to tangent plane 106, and tangent plant 112 is also oblique to tangent plane 108.

Figure 8:
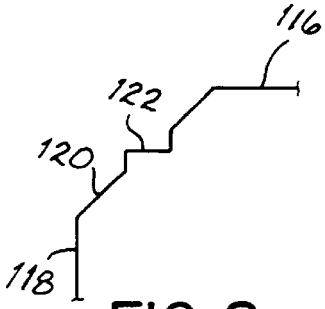
FIG. 8 is a view similar to FIG. 7 illustrating a casket corner which is planar rather than rounded.

Referring now to FIG. 8, there is illustrated another type of corner which could be utilized in the practice of the present invention. In this figure, planar portions 116 and 118 are joined by a third planar portion 120, rather than by a rounded portion as is shown in FIG. 7. Flat 122 is formed on planar portion 120 by the above-described method. As discussed above in conjunction with FIG. 7, the tangent plane of planar portion 120 is oblique to the tangent plane of portion 116 as well as the tangent plane of 118; the flat 122 is preferably formed parallel to the plane defined by portion 116 (i.e., it's tangent plane).

Those skilled in the art will readily recognize numerous adaptations and modifications which can be made to the present invention which will result in an improved method and casket of the invention, yet all of which will fall within the spirit and scope of the present invention as defined in the following claims. For example, the rounded corner need not necessarily be a part of the end panel; it could just as well be a part of the side panel or any other panel or part of the casket. Further, while the term "rounded" has been used to describe the type of corner to which the invention pertains, the term is not to be construed as limiting the invention as any "curved" corner is meant to be embraced thereby, not simply corners which are a portion of a perfect circle or the like. Still further, while the invention has particular applicability to stainless steel caskets, the invention could likewise be employed in conjunction with the fabrication of copper, bronze and other metal caskets having panels that can be formed with stamping operations. And, other materials other than those specifically recited can be utilized. For example mounting tube 82 could be fabricated of brass, and memorial record tube 46 could be fabricated of clear polystyrene. Accordingly, the invention is to be limited only by the scope of the following claims and their equivalents.

What is claimed is:

1. A sheet metal casket comprising:

a pair of side panels;

a pair of end panels;

said side and end panels cooperating to define rounded corners of said casket, said rounded corners each including a curvature associated therewith;

at least one of said rounded corners having a flat comprising a planar surface formed on said curvature thereof, said planar surface having a hole formed therethrough; and a receptacle positioned in said hole and including a terminal portion deformed so as to crimp said receptacle in place.

2. The casket of claim 1 wherein said receptacle is configured to receive a memorial record tube.

3. The casket of claim 1 wherein said receptacle is configured to receive a wedge bar locking mechanism.

4. The casket of claim 1 wherein said planar surface is formed perpendicular to a longitudinal axis of said casket.

5. The casket of claim 1 wherein said planar surface is formed on each said rounded corner of one end of said casket and said hole is formed through each said planar surface.

6. The casket of claim 5 wherein said receptacle is configured to receive a memorial record tube and is positioned and crimped in one said hole and another said receptacle is configured to receive a wedge bar locking mechanism and is positioned and crimped in the other said hole.

7. The casket of claim 6 wherein each said planar surface is formed perpendicular to a longitudinal axis of said casket.

8. The casket of claim 1 wherein said receptacle includes an end inserted through said hole, and wherein said casket further comprises:

an O-ring surrounding said inserted receptacle end and abutting a surface of said panel;

said inserted end being crimped around said O-ring and towards said panel surface.

9. A sheet metal casket comprising:

a pair of side panels;

a pair of end panels attached to said pair of side panels, said end panels each having a rounded corner at each side edge thereof, each said rounded corner including a curvature associated therewith;

at least one of said rounded corners of at least one of said end panels having a flat comprising a planar surface formed on said curvature thereof, said planar surface having a hole formed therethrough; and a receptacle positioned in said hole and including a terminal portion deformed so as to crimp said receptacle in place.

10. The casket of claim 9 wherein said receptacle is a tube configured to receive a memorial record tube.

11. The casket of claim 9 wherein said receptacle is a tube configured to receive a wedge bar locking mechanism.

12. The casket of claim 9 wherein said planar surface is formed parallel to a plane defined by said at least one end panel.

13. The casket of claim 9 wherein said planar surface is formed on each said rounded corner of said at least one end panel and said hole is formed through each said planar surface.

14. The casket of claim 13 wherein said receptacle is configured to receive a memorial record tube and is positioned and crimped in one said hole and another said receptacle is configured to receive a wedge bar locking mechanism and is positioned and crimped in the other said hole.

15. The casket of claim 14 wherein each said planar surface is formed parallel to a plane defined by said at least one end panel.

16. The casket of claim 9 wherein said receptacle is a tube and includes an end inserted through said hole, and wherein said casket further comprises:

an O-ring surrounding said inserted tube end and abutting a surface of said panel;

said inserted end being crimped around said O-ring and towards said panel surface.

17. A sheet metal casket shell comprising:

a pair of side panels;

a pair of end panels;

an arcuate corner between adjacent said side and end panels, said arcuate corner including a curvature associated therewith;

at least one said arcuate corner having a flat comprising a planar surface formed on said curvature thereof, said planar surface having a hole formed therethrough; and hardware positioned in said hole and including a terminal portion deformed so as to crimp said hardware in place.

18. The casket shell of claim 17 wherein said hardware is a receptacle.

19. The casket shell of claim 18 wherein said receptacle is a tube.

20. The casket shell of claim 19 wherein said tube is configured to receive a memorial record tube.

21. The casket shell of claim 19 wherein said tube is configured to receive a wedge bar locking mechanism.

22. The casket shell of claim 17 wherein said planar surface is formed parallel to a plane defined by said end panel.

23. The casket shell of claim 19 wherein said tube includes an end inserted through said hole, an O-ring surrounding said inserted tube end, said O-ring abutting a surface of said panel, and said inserted tube end crimped around said O-ring and towards said panel surface.

24. A sheet metal casket shell comprising:

a sheet metal panel having first and second portions, each said portion having a tangent plane associated therewith, said tangent planes intersecting at an oblique angle;

a flat comprising a planar surface formed on said first portion, said planar surface being parallel to said tangent plane of said second portion;

said planar surface having a hole formed therethrough; and hardware positioned in said hole and including a terminal portion deformed so as to crimp said hardware in place.

25. The casket shell of claim 24 wherein said hardware is a receptacle.

26. The casket shell of claim 25 wherein said receptacle is a tube.

27. The casket shell of claim 24 wherein said first portion is nonplanar and said second portion is planar.

28. The casket shell of claim 24 wherein said first and second portions are planar.

29. The casket shell of claim 27 wherein said first portion is arcuate.

30. The casket shell of claim 29 wherein said first portion is rounded.

31. The casket shell of any of claims 17–30, further including a casket cap secured thereto, said shell and cap forming a casket.

* * * * *